US005666422A

United States Patent [19]

Harrison et al.

[11] Patent Number: 5,666,422

[45] Date of Patent: Sep. 9, 1997

[54] REMOTE SPEAKER FOR SURROUND-SOUND APPLICATIONS

[76] Inventors: Robert W. Harrison, 18 Westfield Park, Cortland, N.Y. 13045; Alan Whitney, 227 Prospect Hill Rd., Horseheads, N.Y. 14845

[21] Appl. No.: 245,624

[22] Filed: May 18, 1994

[51] Int. Cl.[6] ..... H04R 5/00

[52] U.S. Cl. ..... 381/18; 381/24; 381/1; 381/28

[58] Field of Search ..... 381/24, 27, 18, 381/1, 86, 77, 19, 20, 21, 22, 28, 120

[56] References Cited

U.S. PATENT DOCUMENTS

| | | | |
|---|---|---|---|
| 3,069,505 | 12/1962 | Collins et al. | 381/14 |
| 3,478,167 | 11/1969 | Sorkin . | |
| 3,697,692 | 10/1972 | Hafler . | |
| 3,725,586 | 4/1973 | Iida . | |
| 3,757,047 | 9/1973 | Ito et al. . | |
| 4,394,535 | 7/1983 | Bingham | 381/17 |
| 4,612,663 | 9/1986 | Holbrook et al. . | |
| 4,819,269 | 4/1989 | Klayman . | |
| 4,899,388 | 2/1990 | Mlodzikowski et al. . | |
| 5,027,687 | 7/1991 | Iwamatsu | 381/18 |
| 5,181,247 | 1/1993 | Holl | 381/24 |
| 5,386,473 | 1/1995 | Harrison | 381/24 |

FOREIGN PATENT DOCUMENTS

| | | | |
|---|---|---|---|
| 0076699 | 4/1988 | Japan | 381/24 |
| 5276600 | 10/1993 | Japan | 381/19 |

*Primary Examiner*—Minsun Oh
*Attorney, Agent, or Firm*—Barnard, Brown & Michaels

[57] ABSTRACT

A surround-sound system for use with conventional TV sets, using a wireless remote bipolar rear speaker (or two conventional speakers fed out of phase) for the surround (difference) channels. The use of the rear speaker(s) and the mono (left plus right) front speaker on the TV set creates "phantom" left and right front speakers, and allows full surround sound without modification to the TV set or additional amplifiers or speakers.

12 Claims, 3 Drawing Sheets

REMOTE SPEAKER FOR SURROUND-SOUND APPLICATIONS

FIELD OF THE INVENTION

The invention pertains to the field of surround sound apparatus. More particularly, the invention pertains to simulated quadraphonic systems applicable to television home theater or the like.

BACKGROUND OF THE INVENTION

In the average movie theater, two types of "surround" systems are used—the 70 mm 6-track magnetic system, and the more common 35mm optical arrangement. The former uses a magnetic strip attached to the film to supply six discrete channels, and the latter uses two optical audio tracks. This two-channel system is the basis for home surround sound decoders.

Every stereo videodisc, tape and MTS broadcast that was surround encoded still contains the same rear channel information as the two-channel magnetic master from which the theatrical 35mm optical soundtrack was produced. In other words, your stereo videotape or disc of Star Trek I, II, III, Raiders of the Lost Ark, Superman and Star Wars can be decoded to produce surround sound at home. In addition, LPs, CDs and any stereo audio material can benefit from surround sound decoding. Ambiance extraction is a pleasant side effect that many decoders provide. In a nutshell, if the recording was made in a large hall, or a small club, "surround sound" will reproduce the recording environment faithfully.

Assuming the listener is seated centered between the two speakers, sound which is recorded "in phase" and with equal amplitude in each channel in a standard stereo system will appear to the listener to be located equidistant between the two speakers, as the two in-phase audio signals add together. The sound can be shifted left-to-fight by varying the ratio of the amplitude of the left and right signals.

By subtracting the left and fight signals (L–R), the in-phase signals will be cancelled, and the out-of-phase signals are recovered. This is the basis of the "matrix encoding" which is used to record surround information which is inaudible to listeners with conventional stereo equipment.

If a signal is recorded at equal amplitude on each channel of the stereo but 180° out of phase, an exactly centered listener would ideally hear nothing, as the two signals cancel each other out. As a practical matter, the signals are audible, but sound odd—there is almost no centered sound at all, but the source appears to shift past the left or right speaker to be "out there somewhere". This accounts for the occasional feeling when playing a surround-encoded movie on conventional two-speaker stereo equipment that the sound is coming from behind or off to one side or the other.

In a conventional surround system there are four or five speakers. The standard left and right speakers of the normal stereo sound are located in front of the viewer to the left and right of the screen. The left and right rear (surround) signals are reproduced on speakers behind the listener. Many systems will also add a center (Left plus Right, or the same as monophonic) signal in front, under the screen, to add "centering" for dialog.

In recent years there have been two conflicting trends in more-expensive television equipment. First, it has become increasingly common to include stereo decoders in televisions, which in turn requires two speakers for sound reproduction. Second, the portion of the front of the TV which is occupied by the screen has become larger, until there is no room left for even one speaker, let alone two. As a result, although mono TV sets may still have a front-facing speaker (albeit small), the speakers in most stereo TVs have been moved to the sides of the cabinet, usually pointing outward. These closely spaced speakers provide little stereo effect, at best. At the same time, it has become more common than ever to place the TV into an "entertainment center" or bookcase, which surrounds the TV set and blocks the speakers. This results in a loss of whatever stereo effect there might have been.

As a result, many consumers have abandoned the sound system in their TV sets completely, using an external amplifier and speakers (in most cases an existing stereo setup) driven by the stereo output from the TV (if present), or from a VCR to drive two front speakers. This adds considerable expense to the cost of the television, not to mention the need for space for the two additional front speakers. These speakers often cannot be placed too close to the TV because of magnetic effects, and the need to center the TV between them for proper stereo effect restricts the placement of all of the components in the room.

As "surround encoded" videotapes and television transmissions have become more common in recent years there has been an influx of surround decoders on the market. Typical of these are the various Dolby® systems, or the Dynaco model QD-1, which is a version of the decoder described in a 1970 *Audio Magazine* article by David Hailer for use with the then-emerging quadraphonic sound technology (which has since been abandoned). Hafler's U.S. Pat. No. 3,697,692 is essentially the same as the Dynaco QD-1.

These systems require, at a minimum, a stereo amplifier (QD-1) or two (all low-level systems such as Dolby, THX, or the system described in co-pending application Ser. No. 08/184,648) and four or five separate speakers, with associated wiring and cables. The expense can be quite high and setting up such a system is not trivial, especially for the average non-technical consumer.

Several patents have suggested the use of three speakers for stereo setups. For example, see Sorkin, U.S. Pat. No. 3,478,167, or Klayman, U.S. Pat. No. 4,819,269. Neither of these are concerned with surround sound applications, but simply show three-speaker stereo arrangements using difference signals as part of the array of speakers.

Remote wireless speakers for audio applications have been known for some time. For example, see Mlodzikowski, et. al., U.S. Pat. No. 4,899,388, which uses an infrared transmitter to drive two remote battery powered speakers for a conventional stereo system. For many years General Electric sold a wired-wireless (carrier current) monophonic remote speaker under the "Porta-Fi" trademark, and Radio Shack also sold a similar wireless stereo remote speaker system around 1990. Accessory-maker Recoton's Model W100 wireless stereo speaker system also transmitted through the house AC wiring, and their newest wireless speakers use a 900 MHz radio transmitter/receiver setup. Headphone manufacturer Koss has a pair of "Kordlesspeakers" which receive audio signals via an infrared transmitter.

Bipolar speakers have been used in surround systems before, but arranged on the sides of the listening area pointing front and rear, or in front pointing front and rear.

SUMMARY OF THE INVENTION

The invention provides a surround-sound system for use with conventional TV sets, using a wireless remote bipolar rear speaker (or two conventional speakers fed out of phase) for the surround (difference) channels. The use of the rear speaker(s) and the mono (left plus right) front speaker on the TV set creates "phantom" left and right front speakers, and allows full surround sound without modification to the TV set or additional amplifiers or speakers.

DESCRIPTION OF THE PREFERRED EMBODIMENT

The invention comprises a remote speaker system for use with television sets or other components, providing a surround-sound effect which can be easily added to an existing system without great expense or complexity. The system components are a transmitter unit (FIG. 1 and 2, (1)) and a receiver unit with speaker(s) (FIG. 1, (8)–(9); FIG. 2, (13)–(15)).

Figure 1:
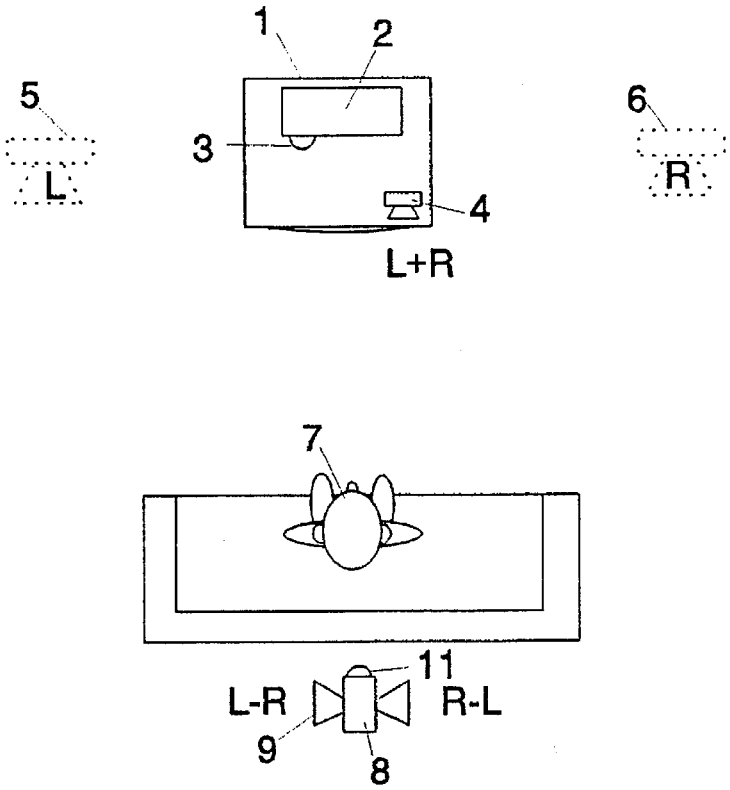
FIG. 1 shows a view of the preferred embodiment of the invention, using IR transmission and a bipolar speaker.
Figure 2:
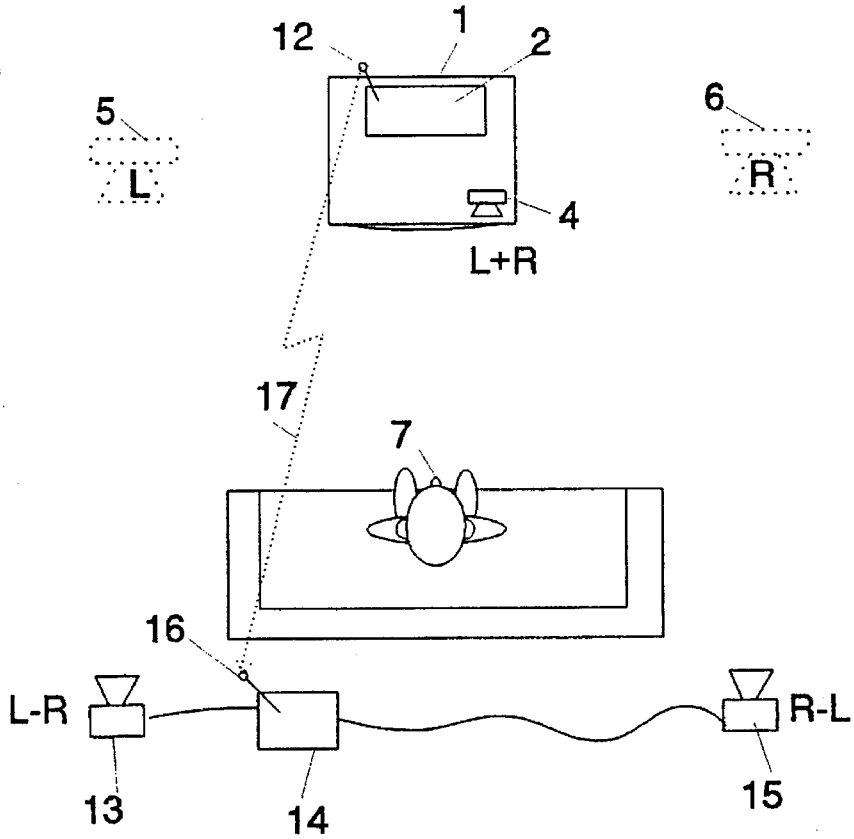
FIG. 2 shows an alternate embodiment of the invention, using RF transmission and a pair of conventional speakers.

FIG. 1 shows the arrangement of the preferred embodiment of the invention in use. The listener (7) sits facing the TV set (1) which has a built-in speaker (4) which provides the monaural (Left plus Right (L+R)) audio of the TV signal. While the invention will be described in the context of an add-on accessory for use with an existing conventional mono TV set, it will be understood by one skilled in the art that it may be used with a stereo TV or home theater system, or built-in to a television at the factory.

On the television set (1) is the transmitter unit (2) of the invention, shown in FIG. 1 in an embodiment having an infrared (IR) diode (3) for transmitting the sound information. The transmitter unit (1) decodes the rear surround information (difference information) from the TV signal stereo sound or other audio information. As will be seen in the discussions of FIGS. 3–5, below, the audio input can be supplied to the transmitter unit, and transmitted to the remote unit, in a number of ways.

The transmitter unit (1) in FIG. 1 transmits the difference sound information, which is a single monaural signal (L–R or R–L), via the IR transmitter diode (3) to the IR detector (11) on the remote speaker amplifier/receiver unit (8), which is located behind the listener (7). The preferred embodiment of the invention uses a bipolar speaker (9) in which a single coil drives a cone which is open on both sides. When fed by the (L–R) difference signal, the bipolar speaker (9) automatically generates (L–R) from the front of the speaker and (R–L) from the back. The bipolar speaker (9) is set up so the sound is directed to both sides, with the (L–R) front of the speaker (if fed by (L–R) signal) directed to the left.

The provision of the difference signals (L–R) and (R–L) behind the listener and the sum signal (L+R) at the TV centered in front of the listener creates the auditory illusion that there are Right and Left front speakers, or "phantom speakers" (shown as dotted speakers (5) and (6)). Thus, conventional stereo (non-surround encoded) signals appear to come from the "phantom" speakers correctly located to the right and left of the screen. If the signal is encoded with out-of-phase surround information, it is correctly decoded and appears in correct relation to the real center speaker and phantom left and right front speakers. Thus, through the use of a single bipolar remote rear speaker and a conventional TV front speaker the user has a true "surround sound" setup as if he/she had the full 5 speakers normally used.

FIG. 2 shows an alternate embodiment of the invention. The IR transmission of FIG. 1 is replaced by a transmitter (12) and receiver (16) linked by a radio frequency (RF) transmission system (17), and the bipolar speaker (9) is replaced by two conventional speakers (13) and (15) driven by an amplifier/remote unit (14). Alternatively, the amplifier/remote unit (14) could be built into the cabinet of one of the two speakers.

Figure 6:
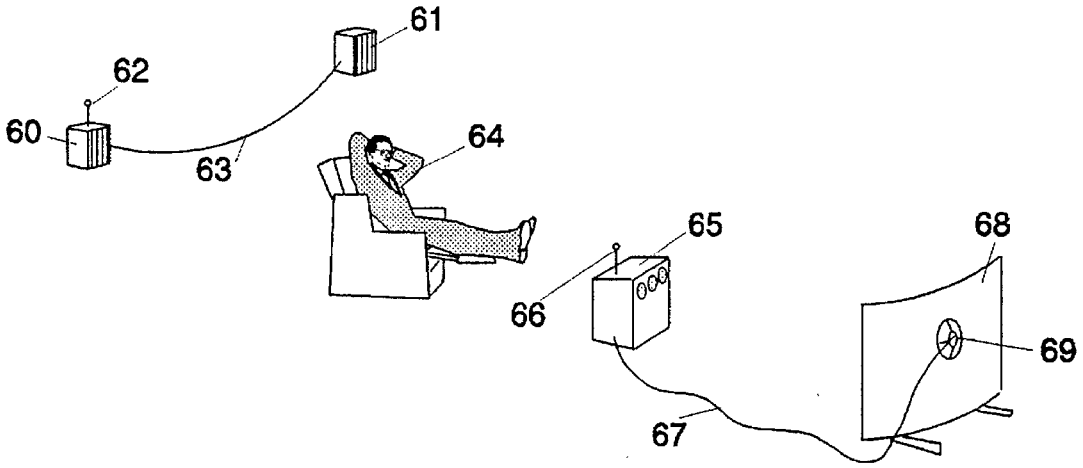
FIG. 6 shows an alternate embodiment of the invention, as used in a projection television setup.

FIG. 6 shows still another alternate embodiment of the invention, as it might be used in connection with large screen projection televisions in a "home theater" environment. The TV projector (65) is a conventional unit, housing the receiver and video projection components. The screen (68) is placed at a distance from the projector (65). A front speaker (69) connected to the projector (65) by a cable (67) is preferably placed behind the screen (68) for maximum centering of the front sound. Alternatively, the front speaker (69) could be mounted above or below the screen. This is all conventional to projection type television sets.

The remote speakers of the invention can be easily added to the projection TV home theater. The transmitter unit can be placed on top of the projector, if an aftermarket system, or it can be built into the projector (65) as shown in FIG. 6. If an RF embodiment of the invention is desired, the antenna (66) could protrude from the top of the projector (65). The remote speakers (60) and (61) would be placed behind the listening area, preferably hung from the wall. The receiver unit is shown built into speaker (60) with its antenna (62) extending above or below the speaker as desired. The speakers are connected by a wire (63).

Figure 3:
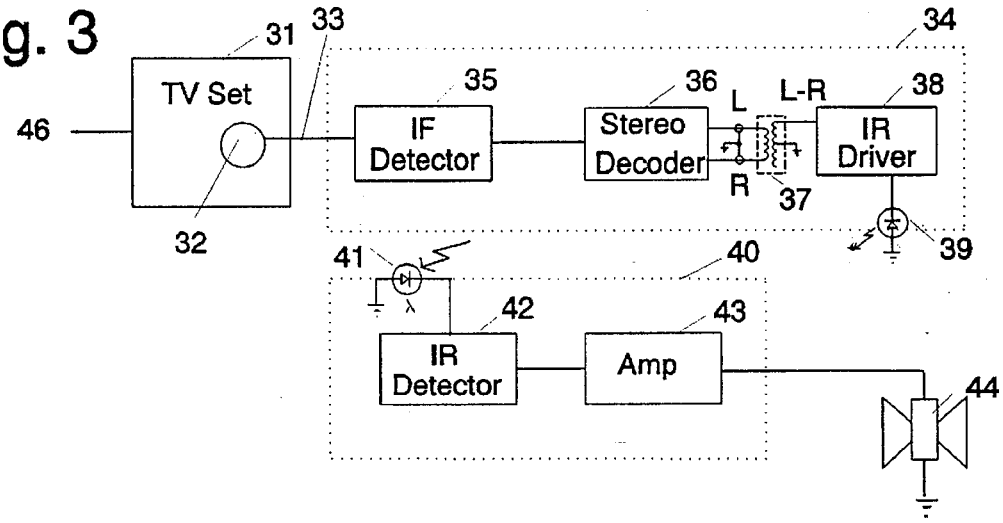
FIG. 3 shows a block diagram of the preferred embodiment of the invention, using IR transmission and a bipolar speaker.
Figure 4:
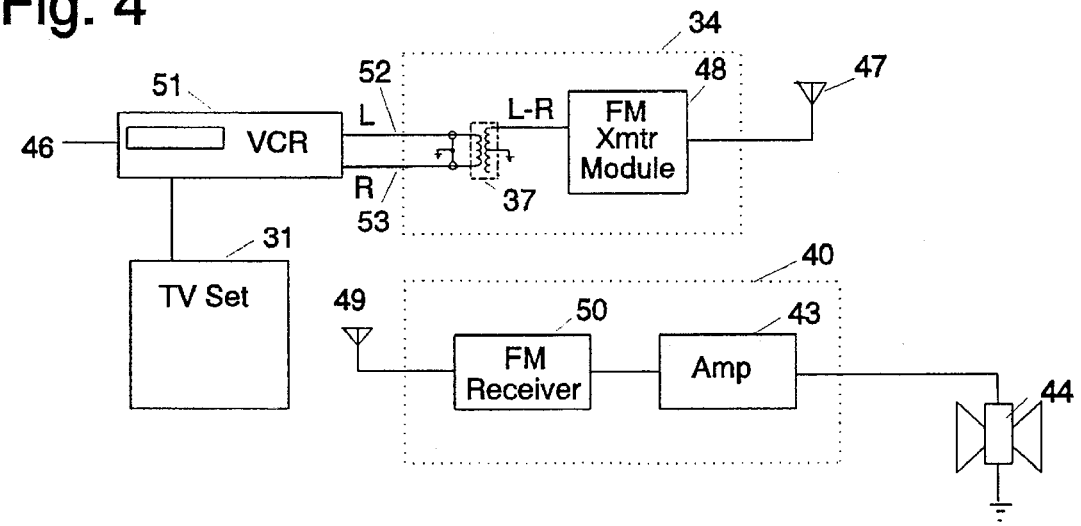
FIG. 4 shows a block diagram of an alternate embodiment of the invention, using RF transmission and a bipolar speaker.
Figure 5:
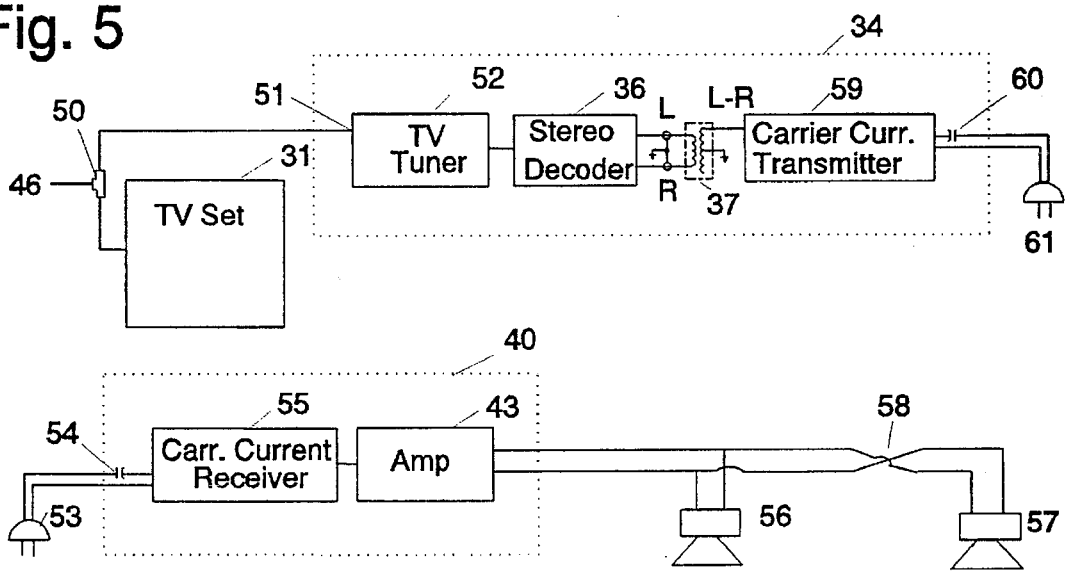
FIG. 5 shows a block diagram of an alternate embodiment of the invention, using carrier current transmission and a pair of conventional speakers.

FIGS. 3 through 5 show block diagrams of alternate embodiments of the invention, having variations in audio signal source, transmission method, and remote speaker types. It will be understood by one skilled in the art that the method of audio derivation or transmission and speaker choice are independent of each other, and can be mixed as required by the dictates of the application.

Power supplies are not shown in FIGS. 3–5, as they will be understood to be completely conventional, and will depend on the exact circuitry chosen and economic considerations. Such commonly used power supply elements as the familiar "brick" transformer unit which plugs into an AC outlet and provides low AC or DC voltage for calculators, answering machines, etc., would be suitable for this application.

FIG. 3 shows an embodiment of the invention as shown in FIG. 1, using IR transmission and a bipolar speaker. Starting at the left, the TV signal source is shown at (46). This can be any source of audio/video signal, such as an antenna, CATV cable or cable converter box, or a VCR, which connects to the antenna terminals of the TV set (31).

The transmitter unit is shown by dotted lines (34). In this embodiment the input is supplied by an inductive pickup (32) and intermediate frequency (IF) detector unit (35). This arrangement is commercially available as the "F.R.E.D." TV stereo decoder, manufactured by Recoton Corporation. The operation is based upon the fact that for economic reasons most TV set tuners convert the incoming signal of whatever channel to the same IF frequency, which allows the use of standardized components for all circuitry following the tuner. This IF signal will leak from the TV set to some extent, and can be picked up and detected by suitable circuitry.

The detected audio is fed into a stereo decoder (36) in order to extract the Left and Right channel signals. This is a standard circuit, which can use any of the commercially available stereo decoder "chips" and associated circuitry.

The difference signal (L–R or R–L) must now be generated from the Left and Right signals. There have been many active circuits patented which can accomplish this (see, for example, Holbrook, U.S. Pat. No. 4,612,663, Ito, et. al. (Sansui), U.S. Pat. No. 3,757,047, or Iida (Sony), U.S. Pat. No. 3,725,586), but the preferred embodiment uses the simple transformer-based low level decoder circuit disclosed in co-inventor Harrison's copending application Ser No. 08/184,648, shown at (37).

The transformer (37) can be any audio type having suitable impedance characteristics for the application. For the typical situation with current technology audio equipment, it would be recognized by one skilled in the art that input impedances in excess of 1KΩ, and outputs at or below 1KΩ would be appropriate. Other applications, or changes in standards in the future, might require other impedance rages, which would be within the ability of one skilled in the art to select. Such a transformer may be purchased from Triad, selected from series SP, which is a series of small transformers, specifically model SP-21.

Since low bass sounds are essentially non-directional, there is no need to pass these frequencies through to the surround channels. Therefore, the preferred transformer has frequency characteristics which are flat above 300Hz, and which roll off –3dB at 200Hz, and essentially cut off frequencies below 100Hz.

The right and left channels of the stereo signal having the out-of-phase surround information is supplied to the primary of the transformer at the end connections. The center tap of the secondary is grounded, and the difference signal is taken from one of the end connections of the secondary.

This difference signal is used as input to an infrared (IR) driver (38) which modulates an IR laser diode (39) to transmit the difference signal. The IR driver circuit can be any conventional circuit, as is commonly used in the art, such as in the Koss "Kordlesspeakers", or in Mlodzikowski, et. al., U.S. Pat. No. 4,899,388, cited above.

Turning now to the receiver unit (40), an IR detector circuit (41) using a detector diode (41) in conventional fashion as used in the above-cited units, detects the difference audio signal from the IR signal. This signal is amplified in an amplifier circuit (43), which can be any commonly available audio amplifier circuit as may be determined by the designer. The power capability of the amplifier does not need to be very large—the surround channels typically need only be about half as powerful as the main (TV set) amplifier.

The amplifier drives a bipolar speaker (44) to produce the surround sound. The bipolar speaker can be any commercially available bipolar speaker of sufficient capacity to handle the power output of the amplifier, such as the model C10T70 driver in a model 510 cabinet from Sondolier.

FIG. 4 shows an alternative embodiment of the invention showing an alternate audio source and a different transmission method from FIG. 5. The TV program source (46) is used as input to a VCR (51) having a tuner capable of decoding the MTS stereo, and/or which can play stereo surround encoded videotapes. The VCR (51) then drives the TV set (31) in any conventional way. The left (52) and fight (53) audio outputs from the VCR are used as the inputs to the difference signal decoder circuit (37), as described above for FIG. 3.

The decoded difference signal (L–R) becomes the audio input to a radio transmitter (48) driving antenna (47). The transmitter is preferably an FM transmitter operating under the license-free "part 15" provisions, such as the ones used in "wireless mic" systems. The transmitter could be one operating on the FM broadcast band, such as used in Radio Shack Model 33–1076 or many commonly available kits and modules. This would allow the mating receiver (50) to be a simple FM broadcast receiver. Alternatively, the transmitter (48) could be on another band, such as the 170 MHz system used by Radio Shack model 32–1224 wireless microphones, or the 902–928 MHz system used by the Recoton remote speakers.

The receiver unit (40) comprises an antenna (49) and matching FM receiver (50) to the transmitter (48), which drives audio amplifier (43) and speaker (44) as shown in FIG. 3.

Still another embodiment using another audio source system, transmission system, and speaker arrangement is shown in FIG. 5. In many cases the input to the home television system (46) is a single channel source such as the output of a cable box, laser disk player or VCR, usually on channel 3 or 4. It is possible, then, to provide the system of the invention with a single channel TV tuner (52) connected in parallel to the TV (31) antenna input by a "T" (50), which can drive any commercially available stereo decoder (36) driving the difference decoder (37), as noted in the discussion of FIG. 3. This would allow the invention to be used with most home TV and VCR systems without any modification to the TV and without any need for either the VCR or TV set to be MTS stereo capable. The remote rear speaker would automatically follow the same program as the TV set when the channel is selected on the cable box or VCR. Alternatively, at somewhat greater expense and increase in complexity of use, the tuner (52) could be fully tunable for use with systems without the fixed channel converter.

The difference signal output becomes the input to a "wired wireless" or "carrier current" transmitter (59). "Wired wireless" is used by many intercom systems, the BSR X-10 wireless remote control systems, and, in the stereo field, the GE Porta-fi remote speakers, as well as the Recoton and Radio Shack units. The signal to be transmitted is imposed upon a low-frequency (≈100KHz) RF signal, and the carrier is coupled (60) to the AC power line, usually using the same power cord as provides the power to run the unit. An appropriate receiver unit (55) can receive the signal by being plugged into any outlet (53) within the same general area.

The receiver unit (40) shown in FIG. 5 is essentially the same as the GE Porta-fi monophonic remote speaker unit, except that instead of a single speaker, two (56) and (57) are provided, fed out of phase by crossing the speaker wires (58) between the speakers. A carrier current receiver (55) is coupled (54) to the AC line (53), detecting the audio on the RF carrier, and driving a conventional audio amp (43), as in the embodiments of FIGS. 3 and 4.

Although all of the embodiments shown have been described in terms of television surround sound, it will be understood by one skilled in the art that many stereo sources such as Compact Disks or FM signals may benefit from surround speakers as well.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. A remote wireless surround sound speaker for use with audio sources having left and right audio signals, comprising:

a) a difference signal transmitter unit comprising decoder means for generating a difference signal representing the difference between the right and left audio signals and transmitter means for transmitting the difference signal to a remote location, wherein the decoder means of the difference signal transmitter unit is a transformer having a primary winding having inputs at each end of the winding and a secondary winding having an output at one end of the winding and a grounded center tap, wherein the left and right audio signals are connected to the inputs at the ends of the primary winding, and the difference signal is output from the output at the end of the secondary winding, and b) a remote receiver unit comprising i) receiver means for receiving and detecting the difference signal transmitted by the difference signal transmitter unit, having an input for accepting the signal from the transmitter unit, and a difference signal output comprising the received audio difference signal, ii) amplifier means for amplifying an audio signal, having an input connected to the difference signal output of the receiver means, and an output for driving speakers with the difference signal, and iii) speaker means connected to the output of the amplifier means, such that the speaker means reproduces a signal representing the difference between the left and right audio signals of the audio source.

2. The remote wireless surround sound speaker of claim 1, in which the audio source is the audio portion of a television signal.

3. The remote wireless surround sound speaker of claim 2, in which the audio source is generated by an IF receiver means for receiving leaked IF signals from a TV set and decoding the left and right audio signals from the leaked IF signals.

4. The remote wireless surround sound speaker of claim 2, in which the audio source is generated by a television tuner.

5. The remote wireless surround sound speaker of claim 2, in which the audio source is generated by a playback means for playing recorded television signals.

6. The remote wireless surround sound speaker of claim 5, in which the playback means is a VCR.

7. The remote wireless surround sound speaker of claim 5, in which the playback means is a laserdisc player.

8. The remote wireless surround sound speaker of claim 1, in which the transmitter means of the transmitter unit transmits an infrared signal, and the receiver means of the remote receiver unit receives the infrared signal transmitted by the transmitter unit.

9. The remote wireless surround sound speaker of claim 1, in which the transmitter means of the transmitter unit transmits a radio frequency signal, and the receiver means of the remote receiver unit receives the radio frequency signal transmitted by the transmitter unit.

10. The remote wireless surround sound speaker of claim 1, in which the transmitter means of the transmitter unit transmits a low-frequency radio signal coupled to an AC power line, and the receiver means of the remote receiver unit receives the low-frequency radio signal transmitted by the transmitter unit from the AC power line.

11. The remote wireless surround sound speaker of claim 1, in which the speaker means of the remote receiver unit is a bipolar speaker.

12. The remote wireless surround sound speaker of claim 1, in which the speaker means of the remote receiver unit is a pair of speakers connected out of phase relative to each other.

* * * * *